US007655116B1

(12) United States Patent
Tilsner

(10) Patent No.: US 7,655,116 B1
(45) Date of Patent: Feb. 2, 2010

(54) ANTI-ELECTROLYSIS SYSTEM INHIBITING THE EROSION METAL OBJECTS

(76) Inventor: Herb Tilsner, 4843 Colt St., No. 10, Ventura, CA (US) 93003

( * ) Notice: Subject to any disclaimer, the term of this patent is extended or adjusted under 35 U.S.C. 154(b) by 483 days.

(21) Appl. No.: 11/728,093

(22) Filed: Mar. 21, 2007

(51) Int. Cl.
*C23F 13/06* (2006.01)
*C23F 13/18* (2006.01)
*C23F 13/20* (2006.01)

(52) U.S. Cl. ..... 204/196.15; 204/196.17; 204/196.23; 204/196.24; 204/196.25; 204/196.3; 204/196.37

(58) Field of Classification Search ..... 204/196.15, 204/196.17, 196.23–196.25, 196.3, 196.37
See application file for complete search history.

(56) References Cited

U.S. PATENT DOCUMENTS 3,641,594 A * 2/1972 Hough ..... 4/510
4,129,493 A 12/1978 Tighe et al.
4,171,256 A 10/1979 Themy
4,260,468 A 4/1981 Bradley
4,472,256 A 9/1984 Hilbig
4,613,415 A 9/1986 Wreath et al.
4,954,263 A 9/1990 Woodhouse
5,558,604 A * 9/1996 Hopkins ..... 482/54
6,287,450 B1 9/2001 Hradil
6,562,243 B2 5/2003 Sherman
6,699,381 B2 3/2004 Nakamura et al.
2002/0190008 A1 * 12/2002 Ashton ..... 210/748
2006/0054568 A1 * 3/2006 Jones et al. ..... 210/748

* cited by examiner

*Primary Examiner*—Bruce F Bell
(74) *Attorney, Agent, or Firm*—Edward A. Sokolski; Don Finkelstein

(57) ABSTRACT

A system for preventing erosion of metal objects in a swimming pool having chemicals therein includes a metal piece sacrificial anode, which may be of zinc. This metal piece sacrificial anode is contained within a tubular container and placed in a location along the swimming pool where it can be readily viewed. The metal piece sacrificial anode is removably supported within the container on the cover of the container, which is threadably attached to the container. The container is supported on piping through which water is supplied to the pool and to the interior of the container. The metal piece sacrificial anode is attached at one end to a an electrically conductive wire and to an electrically conductive copper wire or "bonding wire", which runs around the pool and is attached to metal objects in the pool.

12 Claims, 2 Drawing Sheets

13
12a
14
20
11b
11a
12
11

12''
14b
12
12a
12'
23
20
29
11a
11b
11
14
27

11a
20
23
12
11
11b
12a
13
14
12b
20
19
18a
18

13
38
19
18
14a
25

ANTI-ELECTROLYSIS SYSTEM INHIBITING THE EROSION METAL OBJECTS

FIELD OF THE INVENTION

This invention relates to swimming pools and the like and more particularly to the water in the swimming pool of the type having metals and/or plaster in contact with the water in the pool for inhibiting the effects of electrolysis on the metals and/or plaster by means of a sacrificial anode, which may be fabricated of zinc.

BACKGROUND OF THE INVENTION

1. Description of the Prior Art

Prior art systems for preventing the erosion of metal objects and/or plaster located in swimming pools and the water therein having chemicals such as chlorine therein are well known in the prior art. Such systems inhibit electrolysis, which causes plaster discoloration and erosion of metals in the pool water by employing a sacrificial anode. This anode is preferably of zinc, which gives up its ions rather than the other metals.

In such a system, the metal is depleted as particles are withdrawn therefrom. Such a system is described in U.S. Pat. No. 4,954,263 issued on Sep. 4, 1990 to Woodhouse. In such prior art systems, the metal piece, which acts as a sacrificial anode is located and covered up in a manner so that it cannot be conveniently viewed to determine that the depletion has reached the point at which the anode needs to be replaced. Further, such prior art systems do not provide a simple and convenient procedure for replacing the anode.

2. Features of the Present Invention

In the present invention, there is a metal piece sacrificial anode, which is contained in a transparent tubular container and placed in a location in the filtration system of the pool so that it can readily be viewed from regions external the pool. Thus, when the metal in the metal piece sacrificial anode is depleted to the point at which it needs replacement, this information is readily available by observing the condition of the metal piece sacrificial anode. The metal piece sacrificial anode is attached to the container and can easily and rapidly be removed and replaced as required.

SUMMARY OF THE INVENTION

A metal piece sacrificial anode, which may be fabricated of zinc, is mounted within a transparent tubular container. The container is attached to the pool water piping in the filtration system of the pool. Mating apertures are formed in the bottom of the container and the top wall of the water piping so that water is fed from the water piping into the container so as to surround the metal piece sacrificial anode. This container is removably attached to the water piping and is held in position thereon. An electrically conductive wire is connected at one end to the metal piece sacrificial anode and at the other end to a line known as a "bonding wire," which runs around the pool and is attached to all metal objects in the pool and forms the cathode of an electrical circuit. The metal piece and chemical containing water form the anode of the circuit. The metal piece sacrificial anode gives up its ions into the water faster than the other metals or the plaster in contact with the pool water.

BRIEF DESCRIPTION OF THE DRAWING

The above and other embodiments of the present invention my be more fully understood from the following detailed description taken together with the accompanying drawing wherein similar reference characters refer to similar elements throughout and in which.

DESCRIPTION OF THE PREFERRED EMBODIMENTS

Figure 1:
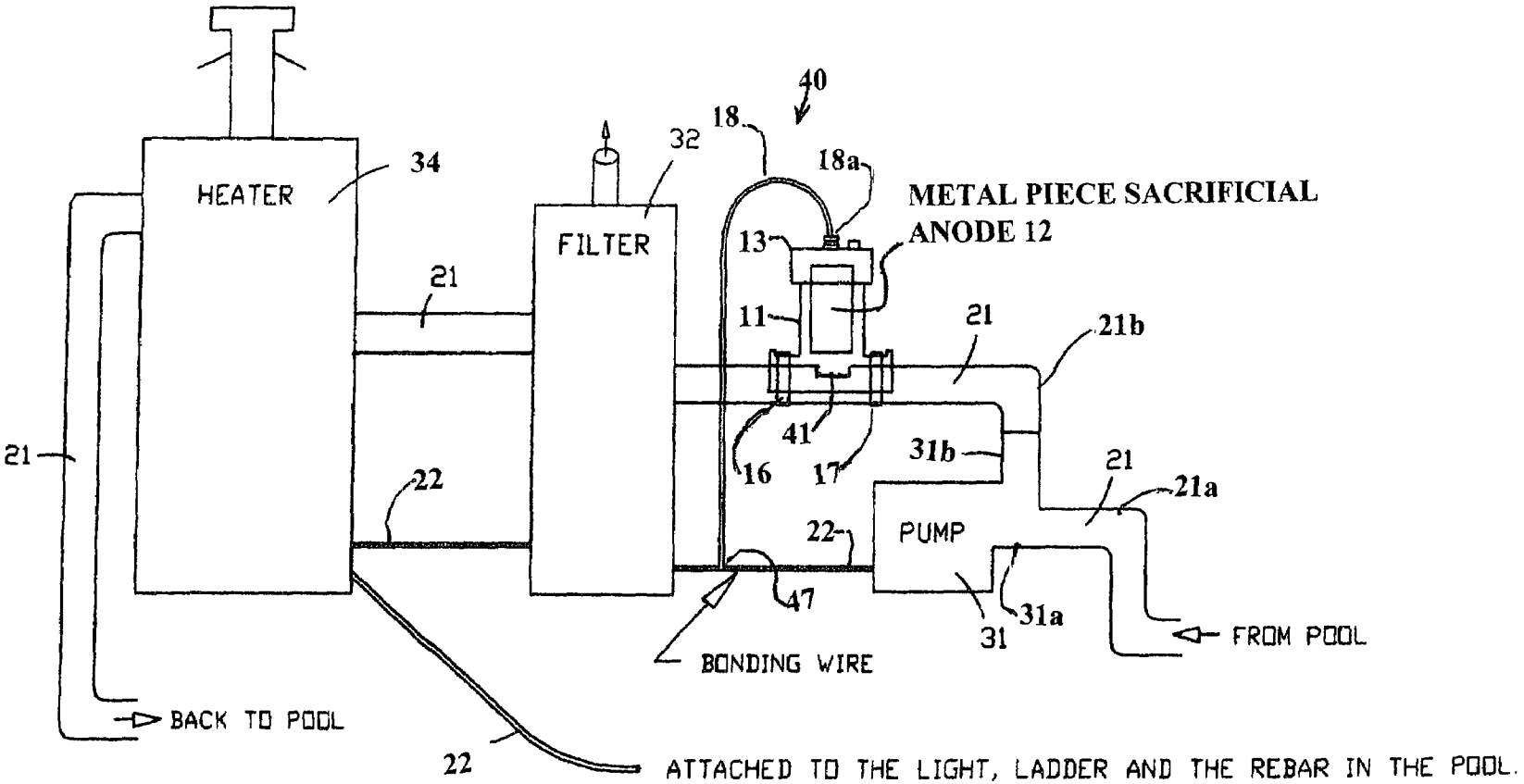
FIG. 1 is a schematic diagram illustrating the system of the present invention.

Referring to FIG. 1, there is shown thereon a schematic representation of a system employing the device of the invention. Water from the pool is pumped from the pool into water pipe 21 by means of pump 31 having an inlet 31*a* and an outlet 31*b*. The water pipe 21 has an inlet After leaving the outlet 31*b* of the pump 31 the water is fed through and passes by a metal piece sacrificial anode 12 which may be made of zinc, to filter 32. Metal piece sacrificial anode 12 is supported on the pipe 21 in a container 11. From the filter 32, the water is fed to heater 34 and from the heater 34, the water is fed back into the pool.

An electrically conductive wire 22 known as a "bonding wire", which may be fabricated of copper, is connected to the metal piece sacrificial anode 12 through the connection of electrically conductive wire 18 as indicated at 47 and the electrically conductive bonding wire 22 is connected to metal objects in contact with the water in the pool such as those in the heater 34, pump 31, filter 32, pool ladder (not shown) and all other metal objects which are to be preserved. Thus, an electrolytic circuit is formed by the metal piece sacrificial anode 12 and other metals and the chemically treated pool water. Ions of the metals tend to be eroded into the pool water. As zinc gives up its metal ions much faster than other metals, the metal piece sacrificial anode 12 being fabricated of zinc will erode long before the other metals. Thus, the metal piece sacrificial anode 12 serves as a "sacrificial" anode so as to obviate erosion of the other metals. When about half of the metal piece sacrificial anode 12 has been eroded, it is generally replaced.

Water is drawn from the pool by the pump 31 through water pipe 21 which has an inlet water pipe portion 21*a* at inlet port 31*a* of the pump 31 and an outlet water pipe portion 21*b* connected to the outlet 31*b* of the pump 31. The water is pumped into the container 11 through the aperture 41 in water pipe 21 and through aperture 11*a* in container 11 (FIG. 3) and over the metal piece sacrificial anode 12. As shown on FIG. 1, the container 11 is connected to the water pipe 21 downstream from the outlet port 31*b* of the pump 31 and outlet portion 21*b* of water pipe 21. The water then flows in the water pipe 21, past the container 11, through the filter 32, through the heater 34 and then back to the pool.

Figures 2, 3, 4:
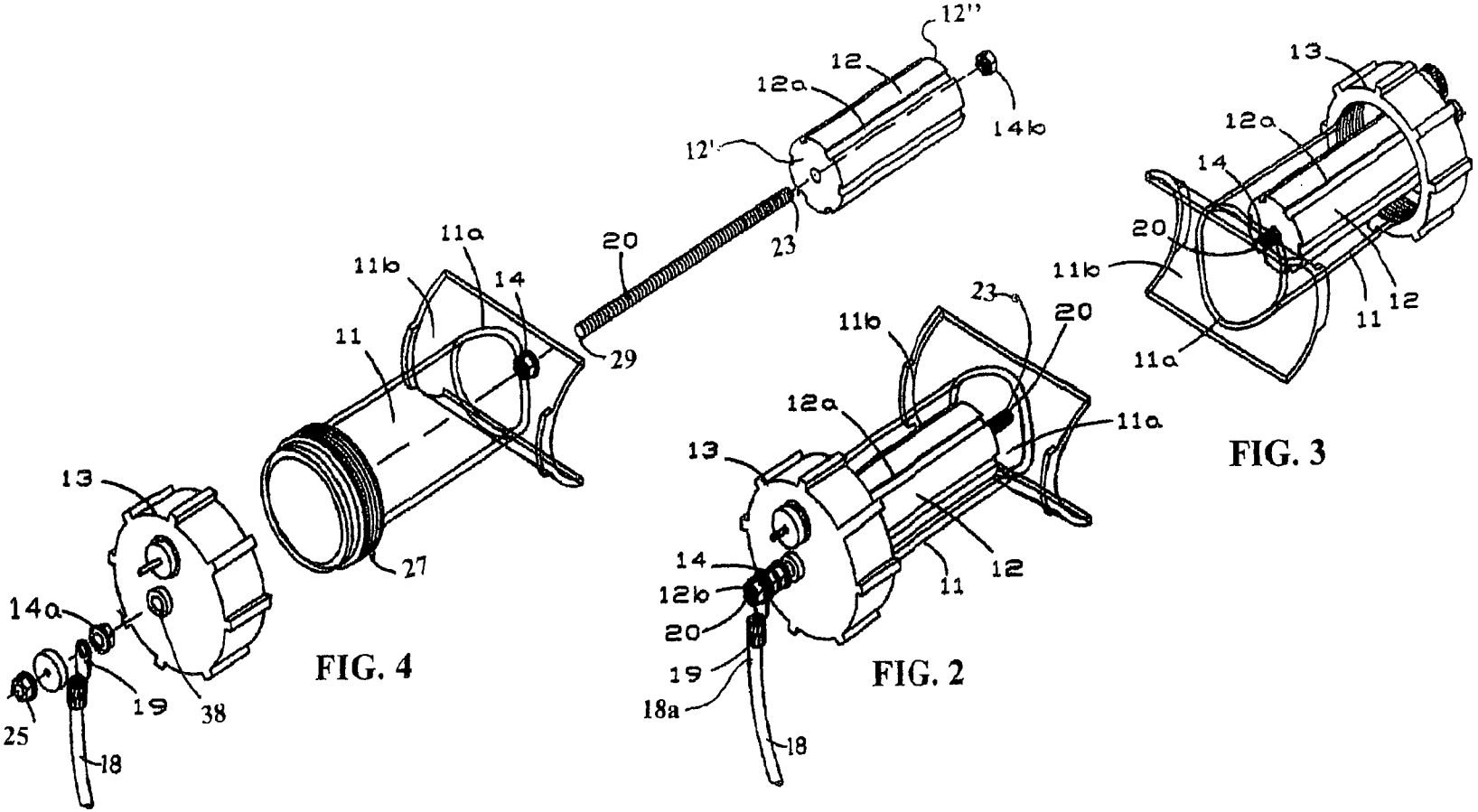
FIG. 2 is a perspective view of the preferred embodiment of the invention taken from the top end thereof.
FIG. 3 is a perspective view of the preferred embodiment of the invention taken from the bottom end thereof; and, FIG. 4 is an exploded view of the preferred embodiment of the present invention.

Referring to FIGS. 2-4, transparent container 11 is cylindrical in configuration and has a the metal piece sacrificial anode 12 mounted therein, which may be fabricated of zinc. Metal piece sacrificial anode 12 is substantially cylindrical and has spaced linear grooves 12*a* therearound. Metal piece sacrificial anode 12 is removably attached to a cover 13 on the container 11 by means of bolt 20, which is joined to the metal piece sacrificial anode 12 by means of the collective action of nuts 14, 14*a* and 14*b*. The bottom end 23 of bolt 20 is in contact with the bottom end 12" of metal piece sacrificial anode 12 by means of the nut 14*b*. Cover 13 is threadingly joined to the threaded top 27 of container 1.

The bottom end 11*a* of the container 11 is curved to matingly fit around the top portion of water pipe 21. The water pipe 21 has an aperture 21*a* formed in the top portion thereof, which matingly fits opposite an aperture 11*a* in the bottom end of the container 11. The container 11 has an extension 11*b*, which may be transparent, and which runs to both sides thereof. Clamps 16 and 17 fit around the extension 11*b* and the water pipe 21 to removably hold the container 11 to the water pipe 21.

An electrically conductive wire 18 is removably attached at one end 18*a* to the top end 12' of metal piece sacrificial anode 12 by means of an electrical connector 19, which is held in place on the top end 29 of bolt 20 by means of nut 25. Bolt 20 extends through an aperture 38 in cover 13 to allow the connection to the electrical connector 19. Wire 18 is connected to a "bonding" wire 22 as indicated at 47 and the bonding wire 22 runs around the pool and is electrically connected to all of the metal objects in the pool.

The container 11 is mounted on the filtration system 40 (FIG. 1) of the pool where it is readily visible so that depletion of the metal piece sacrificial anode 12 can be readily observed. When the visual observation of the metal piece sacrificial anode 12 indicates that the metal piece sacrificial anode 12 is to be made, it can be easily removed by unscrewing cover 13 from the top 27 of the container 11.

From the above, it can be seen that the present invention provides a safe, convenient and easily installed device for use in pools to minimize the erosion and or degradation of the metal objects and/or plaster that is in contact with the water in the pool by utilizing a metal piece sacrificial anode in an electrical circuit and in which the metal piece sacrificial anode gives up its ions faster than the other metal objects in contact with the pool water.

Although specific embodiments of the present invention have been described above with reference to the various Figures of the drawing, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

I claim:

1. In a system for preventing erosion of metal objects in a swimming pool having water therein and said water having chemicals therein, said system having a metal piece sacrificial anode in an electrical circuit, an electrically conductive bonding wire which preferably is made of copper running around said swimming pool and attached to said metal piece sacrificial anode by an electrically conductive wire and to the metal objects in the pool, an electrolytic circuit formed by said metal piece sacrificial anode, said electrically conductive wire, said bonding wire and said metal objects the water in the pool, said electrolytic operating to remove ions from said metal piece sacrificial anode such that erosion of said metal objects is prevented, and a water pipe running around said swimming pool containing supply water for said pool, the improvement comprising, in combination:

a transparent container in which said metal piece sacrificial anode is contained;

said container having a removable cover, said metal piece sacrificial anode being attached to said cover;

means for mounting said container on said water pipe; and means for connecting said container to said water pipe water to receive water therefrom.

2. The system of claim 1 wherein said metal piece sacrificial anode is of zinc.

3. The system of claim 1 wherein said means for mounting said container on said water pipe comprises a curved bottom end of said container which matingly fits around the surface of said water pipe.

4. The system of claim 3 wherein said means for connecting said container to said water pipe to receive water therefrom comprises an aperture formed in said bottom end of said container and an aperture formed in said water pipe which matingly engages said aperture formed in said bottom end of said container.

5. The system of claim 1 wherein said removable cover threadingly engages said container.

6. The system of claim 3 wherein said means for mounting said container on said water pipe additionally includes clamps which fit around said curved bottom end of said container and said water pipe.

7. The system of claim 6 wherein said curved bottom end of said container is transparent.

8. A system for inhibiting the effects of electrolysis in a swimming pool of the type having water therein and metal members in the pool in contact with the water in the pool and comprising, in combination:

a pump for withdrawing water from the pool and having an inlet port and an outlet port;

a water pipe having an inlet water pipe portion connected to said inlet port of said pump for directing water from the pool to said pump, and said water pipe having an outlet water pipe portion connected to said outlet port of said pump;

a container having transparent walls connected to said outlet water pipe portion for receiving pool water therein;

a cover removably mounted on said container;

a metal piece sacrificial anode connected to said cover of said container and visible through said transparent walls.

9. The arrangement defined in claim 8 and further comprising:

an electrically conductive bonding wire connected to said pump and to said metal members in the pool in contact with the water in the pool;

an electrically conductive wire member connected to said metal piece sacrificial anode and to said electrically conductive bonding wire.

10. The arrangement defined in claim 8 wherein:

said container is connected to said outlet water pipe.

11. The arrangement defined in claim 10 wherein:

said container has a curved bottom portion;

said cured bottom portion of said container has an aperture therein;

said water pipe has an aperture therein in alignment with said aperture in said curved bottom portion of said container, whereby water flows from said water pipe into said container and into contact with said metal piece sacrificial anode.

12. The arrangement defined in claim 8 and further comprising:

a filter mounted in said outlet water pipe for receiving water from said container and filtering the pool water;

a heater mounted in said outlet water pipe for receiving water from said filter for heating the pool water;

said pump, said filter and said heater connected to said electrically conductive bonding wire member for electrical continuity therebetween;

an electrically conductive wire connected to said metal piece sacrificial anode and to said electrically conductive bonding wire.

* * * * *